US005522675A

United States Patent [19]

Gunter

[11] Patent Number: 5,522,675

[45] Date of Patent: Jun. 4, 1996

[54] METHOD AND APPARATUS FOR ALIGNING DRAINAGE CHANNEL SECTIONS

[75] Inventor: Charles E. Gunter, Statesville, N.C.

[73] Assignee: ABT, Inc., Troutman, N.C.

[21] Appl. No.: 358,775

[22] Filed: Dec. 19, 1994

[51] Int. Cl.[6] ..... E02B 5/00; E01C 11/22; A44B 21/00

[52] U.S. Cl. ..... 405/118; 404/3; 24/336

[58] Field of Search ..... 405/118, 119, 405/121, 122; 404/2, 3, 5; 24/336

[56] References Cited

U.S. PATENT DOCUMENTS

| | | | |
|---|---|---|---|
| 1,022,008 | 4/1912 | Swick | 405/123 |
| 1,087,791 | 2/1914 | Leavitt | 405/122 |
| 3,552,579 | 1/1971 | Simon et al. | 24/73 X |
| 3,841,101 | 10/1974 | Henfrey | 405/122 |
| 4,498,807 | 2/1985 | Kirkpatrick, et al. . | |
| 4,749,307 | 6/1988 | Huffaker et al. | 405/121 |
| 4,844,655 | 7/1989 | Aleshire . | |
| 4,878,782 | 11/1989 | Beattie et al. . | |
| 4,993,878 | 2/1991 | Beamer | 405/118 |
| 5,066,165 | 11/1991 | Wofford et al. | 405/118 X |
| 5,226,748 | 7/1993 | Barenwald et al. . | |
| 5,281,052 | 1/1994 | Beamer | 405/118 X |
| 5,399,047 | 3/1995 | Stegall | 405/118 X |

FOREIGN PATENT DOCUMENTS

| | | |
|---|---|---|
| 57-178019A | 11/1982 | Japan . |
| 62-260911A | 11/1987 | Japan . |
| 4-73337A | 3/1992 | Japan . |
| WO7900848 | 11/1979 | WIPO . |

*Primary Examiner*—Frank Tsay
*Attorney, Agent, or Firm*—Bell, Seltzer, Park & Gibson

[57] ABSTRACT

A drainage channel system for forming a trench is disclosed according to the present invention. The drainage channel system includes a number of precast drainage channel sections and one or more alignment keys for aligning and interlocking adjacent drainage channel sections. Each alignment key includes first and second opposed, inwardly facing jaw members shaped for longitudinally bridging across a predetermined exterior portion of adjacent first and second sidewalls, respectively, of adjacent drainage channel sections. Accordingly, each jaw member engages the predetermined exterior portions of the respective sidewalls to longitudinally interlock the drainage channel sections. In particular, each jaw member includes opposed clamping tabs having longitudinally opposed surfaces which apply a longitudinally compressive force to the adjacent drainage channel sections. In addition to longitudinally interlocking the adjacent drainage channel sections, the alignment key advantageously includes surfaces which substantially align the adjacent drainage channel sections both vertically and laterally.

59 Claims, 4 Drawing Sheets

METHOD AND APPARATUS FOR ALIGNING DRAINAGE CHANNEL SECTIONS

FIELD OF THE INVENTION

The invention relates to methods and apparatus for forming trenches. More particularly, the invention relates to methods and apparatus for forming trenches with precast drainage channel sections.

BACKGROUND OF THE INVENTION

Drainage and other trenches of various sizes and shapes are desirable for numerous applications. For example, manufacturing facilities typically require drainage systems which include trenches formed in the building floors to collect, remove and/or recycle excess water or other liquids. In addition, numerous outdoor industrial and commercial sites, such as large parking lots and airports, require drainage systems, including trenches, to collect and direct rainwater and other liquids to underground storm sewers to prevent flooding and to decrease run-off.

One method of forming these trenches has included placing and securing a number of precast drainage channel sections in a ditch which has previously been formed in the ground. A hardenable composition, such as cement, concrete or the like, is then poured around the drainage channel sections and is allowed to set.

Once the concrete has set, it is normally desirable to finish the trench with an elongate grate covering its open top in order to prevent people from unwittingly stepping in the open trench, to provide a smooth surface for vehicle travel, and/or to prevent relatively large objects from entering the trench and potentially blocking the flow of liquid therethrough. The grate is generally supported by a support surface defined longitudinally along an inner portion of each opposed sidewall of the drainage channel sections. In order to stabilize the grate to prevent the grate from rocking when weight, such as from a passing vehicle, is applied thereto, the support surfaces defined by the opposed sidewalls of the drainage channel sections must be aligned in a common plane during the pouring and setting of the concrete about the drainage channel sections. In addition, if the grate is not properly aligned, the grate and/or the drainage channel itself can be damaged by the resulting movement of the grate. Furthermore, if the grate rocks excessively, the grate may even be dislodged from the drainage channel to expose the trench defined thereby. Accordingly, the alignment of the drainage channel sections in the moldable trench forming composition is important to the construction of a satisfactory trench.

Many drainage and other trenches are formed of a number of drainage channel sections. It is also important to align the adjacent drainage channel sections such that the sidewalls and bottom wall of the trench defined by the adjacent drainage channel sections form continuous surfaces such that fluid flows smoothly therethrough and does not pool within the trench.

One common method of securing precast channel sections in an aligned relationship within a preformed ditch includes an anchor, such as that described in U.S. Pat. No. 4,498,807 which issued on Feb. 12, 1985 to Larry E. Kirkpatrick, et al. and assigned to Polydrain, Inc. (hereinafter the "'807 patent"). As illustrated in the '807 patent, an anchor generally includes a pair of downwardly extending, elongated spikes which are held in a parallel, spaced-apart relationship by a generally rectangular crosspiece. The anchor also includes a pair of upwardly extending arms that have a predefined shape which corresponds to and engages the predetermined exterior shape of lower portions of the precast channel sections. For example, each opposed sidewall of the precast channel sections can include an outwardly projecting rib extending longitudinally along lower portions of the channel sections. Correspondingly, upper portions of the arms of the anchor can include inwardly extending tabs which engage the longitudinally extending ribs and secure the anchor to lower portions of the channel sections. Accordingly, the anchor can be attached to a precast channel section and the elongated spikes can be inserted into the ground such that the drainage channel section is held at a fixed position within the preformed ditch. Concrete can thereafter be poured about the channel sections to form the completed trench.

The anchors of the drainage channel system of the '807 patent therefore provide a means to accurately position or place each drainage channel section within the ditch. Accordingly, adjacent drainage channel sections can be aligned such that the side walls and bottom surfaces of the channel sections are contiguous. In one embodiment, the bottom surfaces of the drainage channel sections include a bottom surface which has a predetermined slope to facilitate drainage or fluid flow. According to this embodiment, the anchors of the drainage channel system of the '807 patent can position the individual drainage channel sections in an aligned relationship such that the presloped bottom surfaces are contiguous.

Another device for aligning adjacent drainage channel sections is described in U.S. Pat. No. 5,226,748 to Jörg R. B ärenwald et al., which issued on Jul. 13, 1993 and is assigned to ACO Polymer Products, Inc. (hereinafter the "'748 patent"). The '748 patent describes a clip-type support which engages, clamps and supports the end portions of adjacent drainage channel sections. The clip-type support includes two spaced-apart clip structures and an interconnecting central web. Each clip structure has a predetermined shape which corresponds to and mates with the predetermined exterior shape of the end portions of the adjacent drainage channel sections. In particular, each clip structure includes an elbow which receives and supports an outwardly projecting rib which extends longitudinally along the opposed sidewalls of the drainage channel sections. Thus, the adjacent drainage channel sections can be supported in an aligned relationship by the clip-type device. The center web of the clip-type support also includes a pair of outwardly extending tabs. In addition, the clip-type support includes a number of vertical support rods, each having a first end which extends through apertures defined in a respective outwardly extending tab. Each vertical support rod also includes a second end, opposite the first end, which can be imbedded in the ground to support the drainage channel sections in a predetermined spaced relationship above the bottom of the ditch.

In addition to being positioned in an aligned relationship, it is important that the adjacent drainage channel sections be urged together and interlocked to minimize fluid leakage between adjacent drainage channel sections and escape from the trench. This is normally accomplished manually by careful checking of individual channel sections as they are placed on the individual supports. However, this is a time consuming process requiring substantial attention to detail, and it is easy to accidentally move a previously aligned channel section as a later channel section is being adjusted. In a like fashion, previously aligned channel sections can move or shift while the hardenable composition is poured about the channel sections.

SUMMARY OF THE INVENTION

The present invention provides improved trench forming methods and apparatus. In one aspect, the invention provides an alignment key for aligning and longitudinally interlocking adjacent drainage channel sections. In other aspects, the invention provides a drainage channel system which allows a plurality of drainage channel sections to be readily aligned and longitudinally interlocked within a preformed ditch.

In a first aspect, the invention provides an alignment key for aligning and longitudinally interlocking adjacent drainage channel sections. Each longitudinally extending drainage channel section has a predetermined exterior shape defined by a bottom wall and first and second sidewalls extending upwardly from opposite sides of the bottom wall. In accordance with this aspect, the alignment key includes first and second opposed, inwardly facing jaw members shaped for longitudinally bridging across a predetermined exterior portion of adjacent first, and adjacent second sidewalls, respectively, of the adjacent drainage channel sections. Each of the jaw members includes longitudinally opposed surfaces, or clamping members, shaped to engage the predetermined exterior portions of the respective sidewalls. The longitudinally opposed surfaces of the jaw members apply a longitudinally compressive force to the adjacent drainage channel sections to substantially align and interlock the drainage channel sections.

In one embodiment, the exterior portion of the first and second sidewalls of the drainage channel includes an exterior angled or beveled surface oriented in both a longitudinal and an laterally outward direction. The corresponding longitudinally opposed surfaces of the inwardly facing jaw members are preferably laterally inwardly converging along a longitudinal axis of the drainage channel sections so as to engage the exterior angled surface of the channel sidewalls. Advantageously, the corresponding longitudinally opposed surfaces are inwardly converging in generally opposed longitudinal directions. Preferably the alignment key also includes at least one connecting member connecting bottom portions of each of the opposed jaw members in a laterally spaced relationship. A laterally movable member preferably cooperates with a connecting member to adjust the lateral space between the opposed jaw members and to apply a laterally inwardly directed force to the opposed jaw members. In the preferred construction the application of laterally inward force to the sidewalls of the channel by the inwardly converging laterally opposed portions of the jaws results in application of the longitudinally compressive force to the adjacent channel sections.

Each jaw member can also include corresponding vertically extending surfaces positioned to engage predetermined exterior portions of the respective sidewalls. Preferably, the vertically extending surfaces are laterally inwardly converging along a generally vertical direction.

In addition to applying a longitudinally compressive force, the alignment key of the present invention also preferably laterally and vertically aligns the adjacent drainage channel sections. In particular, each jaw member advantageously includes a surface positioned to engage the predetermined exterior portions of the respective sidewalls to maintain the adjacent drainage channel sections in a laterally aligned relationship. Further, each jaw member includes a surface positioned to engage the predetermined exterior portions of the respective sidewalls to align the adjacent drainage channel sections in a predetermined vertical relationship. In one embodiment, the bottom walls of the drainage channel sections are vertically sloping. In this embodiment, the vertical alignment surface of each jaw member is preferably positioned to align the adjacent drainage channel sections in a predetermined vertically sloping relationship.

Each jaw member can also include at least two horizontally extending, vertically spaced portions, each of which defines a bore. Each of the bores is advantageously aligned in a vertical direction. A plurality of vertical support members are received by the generally vertically aligned bores of the horizontally extending portions. However, at least one of the horizontally extending portions is adapted for movement relative to an initial vertical alignment of the bores in response to a predetermined force, such as the laterally inwardly directed force, to thereby change the vertical alignment of the bores and lock the jaw member onto the vertical support. For example, at least one of the horizontally extending portions can be adapted for movement either in the vertical or the horizontal direction. In one embodiment, the vertical support members are legs of a generally U-shaped member.

In one embodiment of the present invention, the jaws are configured for use with drainage channel sections which each have an outwardly extending lip of a predetermined width proximate the opposed ends thereof. Each jaw member includes a recessed central portion defined between the opposed longitudinal surfaces that has a predetermined longitudinal width adapted to receive lips of the adjacent drainage channel sections.

According to a preferred method of the present invention, a plurality of drainage channel sections are aligned, preferably both vertically and laterally, and are longitudinally interlocked by one or more alignment keys. The aligned drainage channel sections are then anchored in a preformed ditch and a hardenable composition is poured thereabout to form the completed drainage channel as it sets. Advantageously the alignment of the adjacent drainage channel sections, is accomplished by urging the opposed jaw member against the respective sidewalls of the channel sections, such as by application of a laterally inwardly directed force. The laterally inwardly directed force advantageously also fixes the position of a vertical support member relative to the bores defined in the horizontally extending portions of the jaw members. Once the position of the vertical support members have been fixed relative to the jaw members, the aligned drainage channel sections are preferably anchored by forming a subslab around lower portions of the vertical support members at a location spaced below the bottom surface of the drainage channel sections. Consequently, an aligned, longitudinally interlocked trench comprised of a plurality of contiguous drainage channel sections can be readily formed according to the method and using the apparatus of the present invention.

BRIEF DESCRIPTION OF THE DRAWINGS

In the drawings which form a portion of the original disclosure of the invention.

DETAILED DESCRIPTION OF A PREFERRED EMBODIMENT

Figure 1:
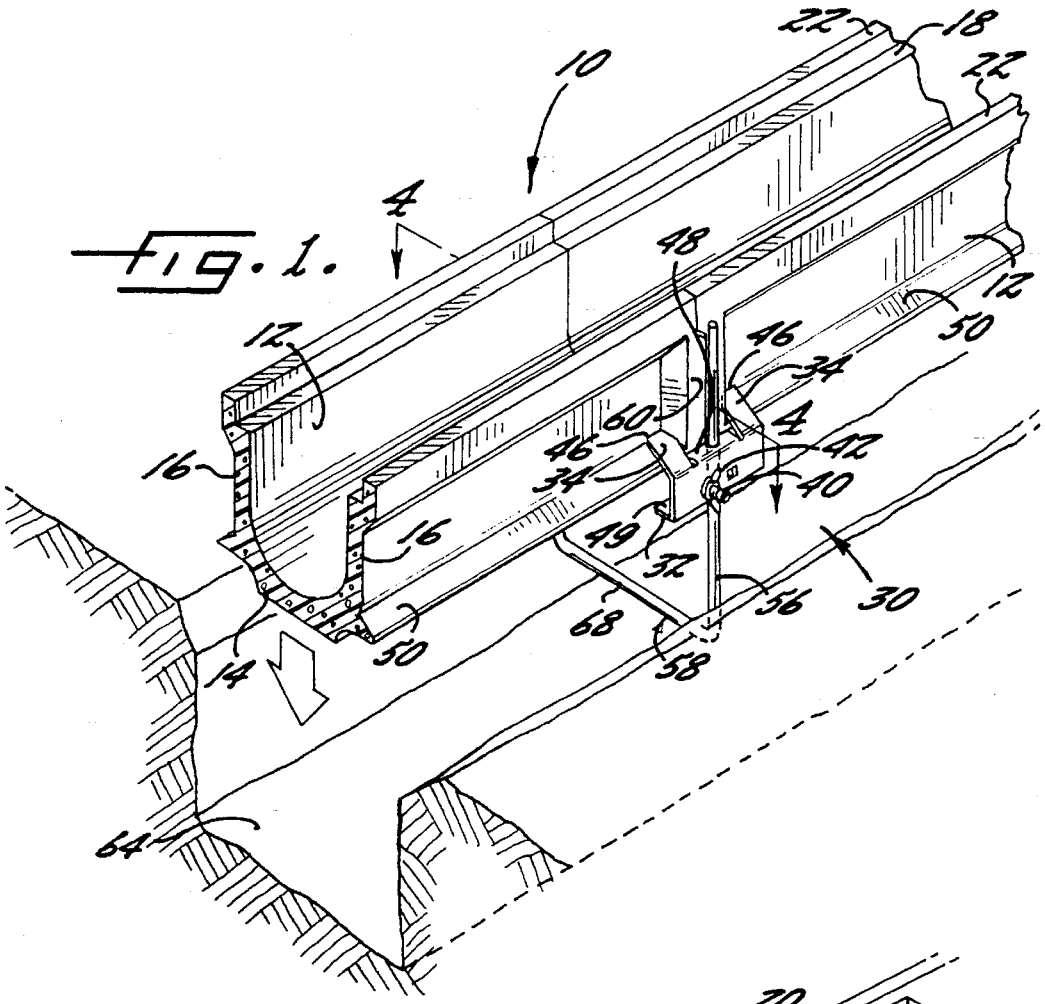
FIG. 1 is a perspective view of one preferred drainage channel system according to the present invention illustrating its placement in a preformed ditch.

Various methods and apparatus embodiments of the invention are set forth below. While the invention is described with reference to specific preferred methods and apparatus including those illustrated in the drawings, it will be understood that the invention is not intended to be so limited. To the contrary, the invention includes numerous alternatives, modifications and equivalents as will become apparent from consideration of the present specification including the drawings, the foregoing discussion, and the following detailed description.

Referring now to FIG. 1, a drainage channel system 10 according to one embodiment of the present invention is illustrated during placement in a preformed ditch. As shown, the drainage channel system includes a plurality of longitudinally extending preformed or precast drainage channel sections 12. The drainage channel sections can be precast from various cementitious materials depending upon the type of fluid which the trench is to collect and the type of loads which the trench is to designed support. For example, precast drainage channel sections are typically formed of polyester concrete, a concrete aggregate material containing coarse and inert mineral fillers bonded with polyester resin. As will be apparent, the channel sections can be cast from other cementitious and/or thermoformable or thermosetting polymers or formed from cast or formed metals such as stainless steel sheet.

Figure 2:
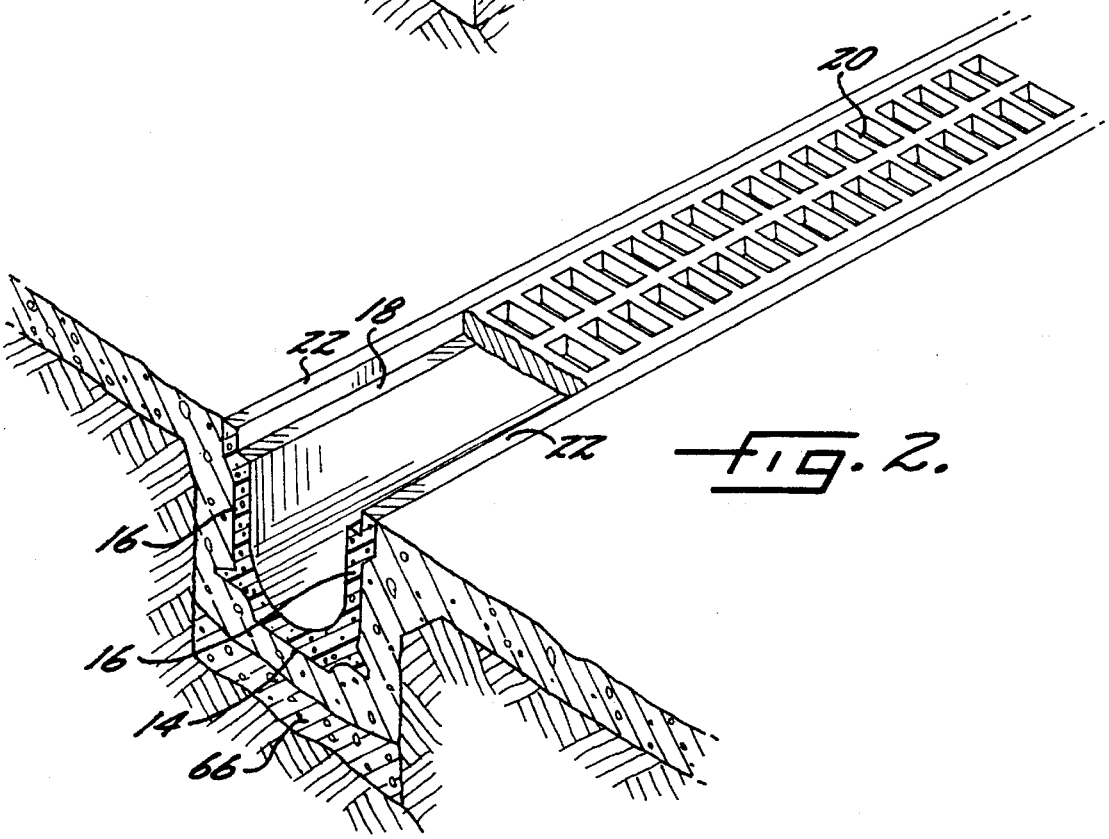
FIG. 2 is a perspective view of the drainage channel system of FIG. 1 following placement thereof in a preformed ditch and pouring of hardenable composition about the drainage channel sections.

Each drainage channel section 12 has a predetermined exterior shape defined by a bottom wall 14 and first and second sidewalls 16 extending upwardly from opposite sides of the bottom wall. Upper portions of the opposed first and second sidewalls each include a longitudinally extending support surface 18. Each support surface preferably extends substantially horizontally and is adapted to receive and support a grate 20 which covers the open top of the drainage channel as shown in FIG. 2.

Each opposed sidewall 16 also preferably includes a longitudinally extending upper edge portion 22 extending upwardly along an outer portion of each support surface 18. As shown, the vertical distance from the upper edge portion 22 to the support surface 18 is preferably substantially equal to the thickness of the grate 20 such that the grate is aligned with upper portions of the sidewalls to provide a smooth surface, e.g., for vehicle travel. The support surface and the adjacent upwardly extending edge portion of the opposed sidewalls of the drainage channel section 12 are preferably sized to receive the grate and to stabilize the grate by preventing excessive lateral movement of the grate and by preventing the grate from rocking when weight is applied thereto.

The drainage channel system 10 of the present invention also includes an alignment key 30 for aligning and interlocking adjacent drainage channel sections 12 as shown in FIG. 1. While the alignment key can be formed of various materials, the alignment key of one embodiment is formed of steel, such as 12, 14 or 16 gauge low carbon steel. As illustrated in more detail in FIGS. 3–5, the alignment key includes first and second opposed, inwardly facing jaw members 32. The jaw members are of sufficient longitudinal length, and are shaped for longitudinally bridging across predetermined exterior portions of the adjacent first, and adjacent second sidewalls 16, respectively, of the adjacent drainage channel sections. More specifically, the first jaw member 32 is shaped for longitudinally bridging across predetermined exterior portions of the adjacent first sidewalls 16 of the adjacent drainage channel sections 12. Likewise, the second jaw member is shaped for longitudinally bridging across predetermined exterior portions of the adjacent second sidewalls of the adjacent drainage channel sections.

Figure 4:
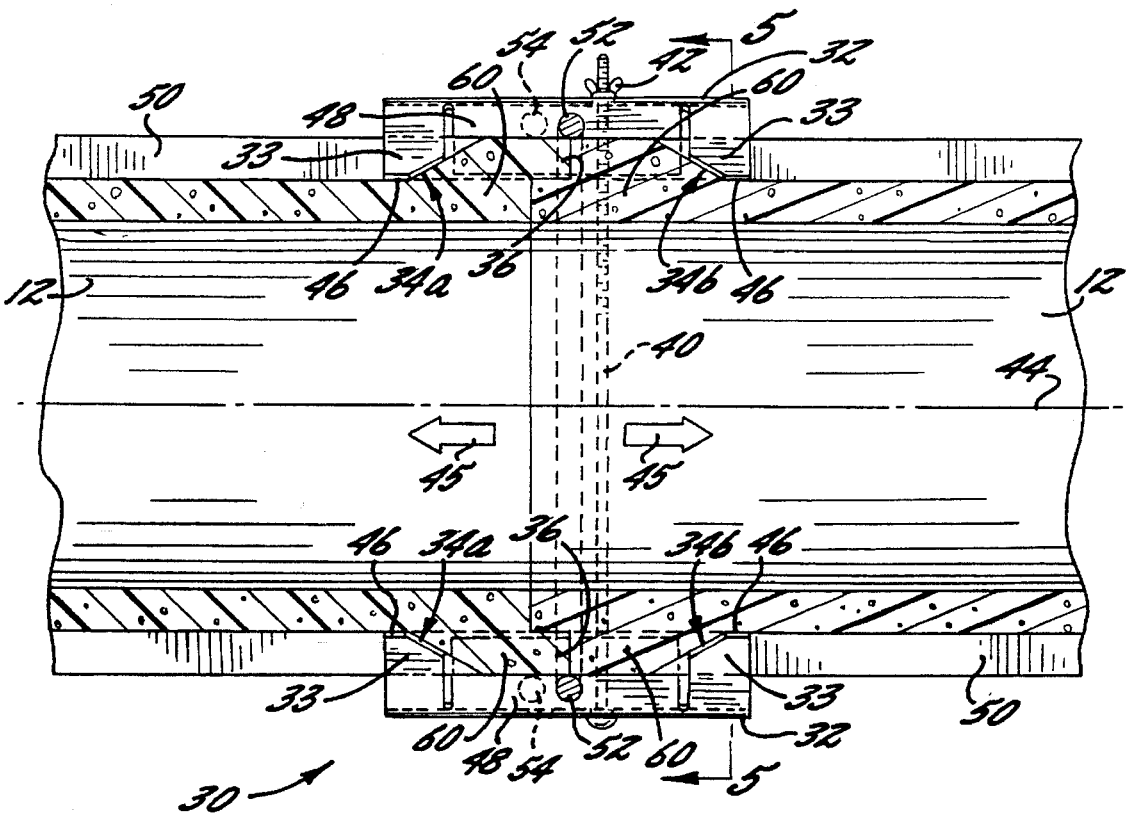
FIG. 4 is a top cross-sectional view of the drainage channel system of FIGS. 1–3 taken along line 4—4 of FIG. 1.

As best illustrated in FIG. 4, each of the jaw members 32 includes two clamping tabs or members 33 which include longitudinally opposed clamping surfaces 34*a* and 34*b*, shaped to engage the exterior portion of a sidewall 16 and to urge the adjacent drainage channel sections 12 into an aligned, longitudinally engaged relationship. The longitudinally opposed surfaces 34*a* and 34*b* are diagonally oriented with respect to the longitudinal axis of the channel sections 12 and are thus opposed with respect to both the longitudinal and lateral axes of the channel section. As discussed in greater detail later, the longitudinally opposed surfaces 34*a* and 34*b* apply a longitudinally compressive force to the adjacent drainage channel sections as the jaw member is moved in the laterally inward direction towards the center longitudinal axis of the channel sections to thereby substantially align and interlock the channel sections. Consequently, the resulting trench defined by the drainage channel sections has aligned side and bottom walls and a relatively tight seal can be obtained between adjacent drainage channel sections.

Figure 3:
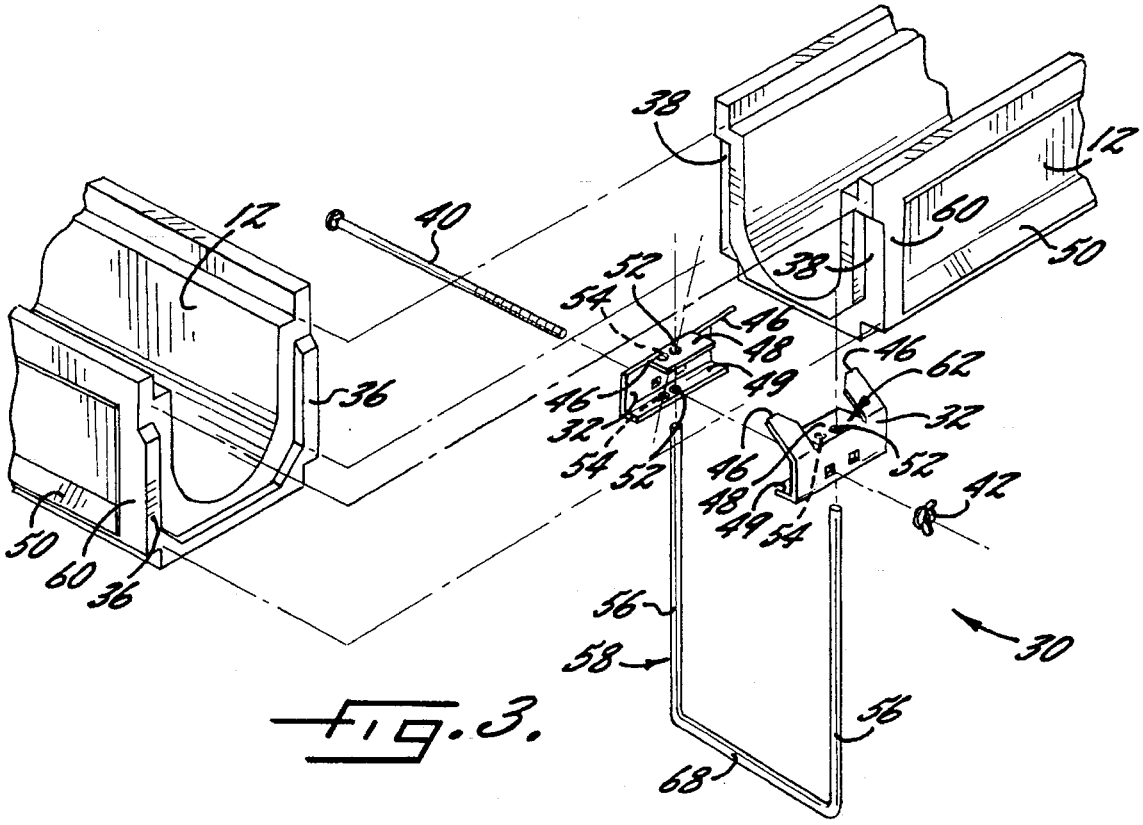
FIG. 3 is an exploded perspective view of one preferred alignment key according to the present invention illustrating its relationship to the end portions of a pair of adjacent drainage channel sections and wherein the end portion of one channel section is shown in a rearranged horizontally transverse orientation in order to better illustrate the end face thereof.

Although any of various channel constructions can be used in the invention, as illustrated in FIG. 3, the alignment and interlocking of adjacent drainage channel sections can be facilitated by channel sections having corresponding male and female portions 36 and 38, respectively, defined by end portions of the adjacent drainage channel sections 12. More particularly, the end portion of a first drainage channel section can include a male lip or tongue portion 36 adapted to fit into a corresponding female recess or groove portion 38 defined on an end portion of a second adjacent drainage channel section. As shown in FIG. 3, in one preferred channel construction the male portion defined at an end portion of a first drainage channel section includes a lip forming portions of the bottom wall and both sidewalls of the channel section which extends longitudinally outward from the end surface of the drainage channel section. Correspondingly, the female portion defined at an end portion of a second drainage channel section includes a recessed portion in the sidewalls and bottom wall of the channel section which is adapted to receive the longitudinally extending projections of the first drainage channel section. In addition, a sealant or other type of adhesive can be disposed between the end portions of the adjacent drainage channel sections to further seal the adjacent drainage channel sections.

Advantageously the alignment key 30 also includes at least one connecting member 40 adjustably connecting bottom portions of each of the opposed jaw members 32 in a variable laterally spaced relationship. The connecting member preferably cooperates with a laterally movable member 42 to adjust the lateral spacing between the opposed jaw members. In particular, the laterally movable member and the connecting member cooperate to apply a laterally inwardly directed force to the opposed jaw members.

In the illustrated embodiment, the connecting member 40 includes a threaded rod or bolt which is received by apertures defined in side portions of the jaw members 32. In the illustrated embodiment, the laterally movable member 42 comprises a wing nut which can be threaded onto the threaded portion of the bolt such that a laterally inwardly directed force is applied to the jaw member to draw or bias the jaw members laterally inward. Due to the complimentary shapes of the exterior surface of the adjacent drainage channel sections 12 and the longitudinally opposed surfaces 34 of the jaw members 32, the application of a laterally inwardly directed force to the opposed jaw members applies the longitudinal compressive force to the drainage channel sections, thereby longitudinally interlocking the drainage channel sections.

While a single connecting bolt and nut assembly is illustrated, two or more connecting bolt and nut assemblies can be employed without departing from the spirit and scope of the present invention. In addition, numerous other types of connecting members 40, such as threaded standoffs or other couplers, and laterally movable members 42 as will be readily apparent to the skilled artisan other than a connecting bolt and an associated nut, can be employed according to the present invention.

Figure 5:
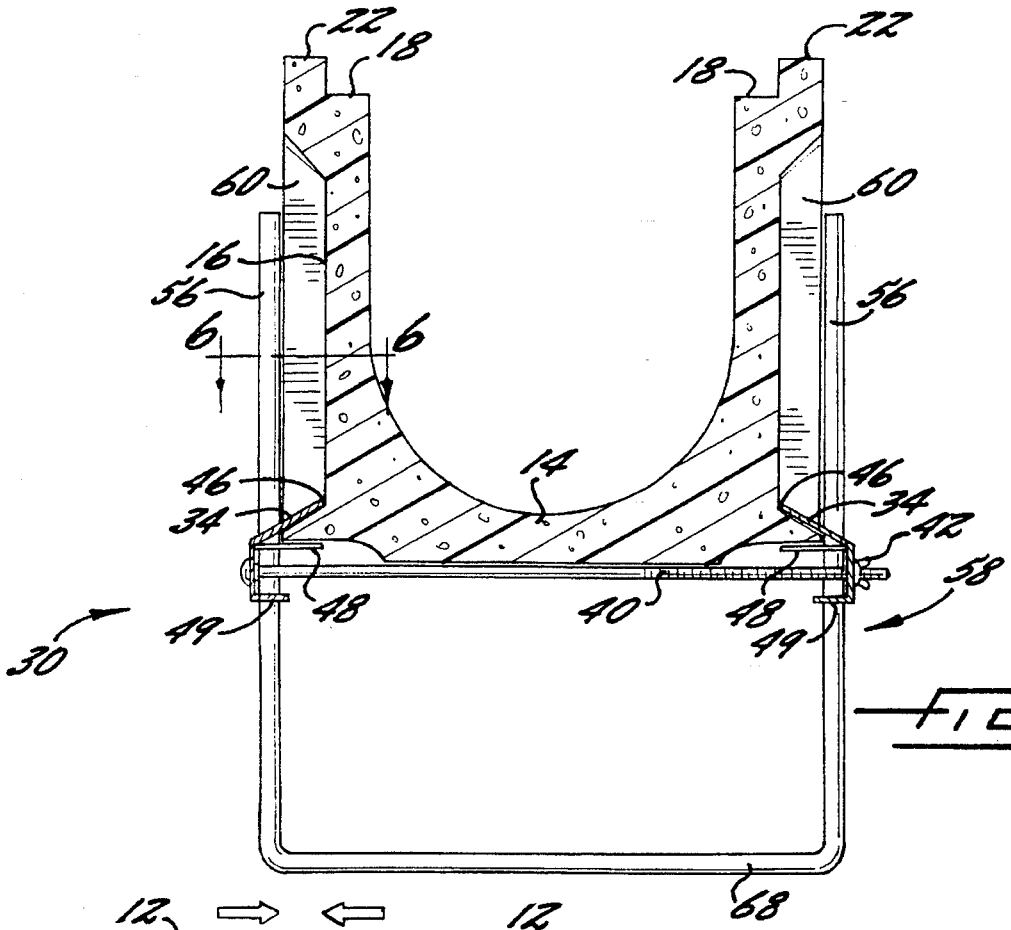
FIG. 5 is a transverse cross-sectional view of the drainage channel system of FIGS. 1–4 taken along line 5—5 of FIG. 4.

As illustrated in FIG. 5, the connecting member 40 preferably extends substantially horizontally beneath the drainage channel sections 12 between lower portions of the opposed jaw members 32. In addition, the connecting member is illustratively spaced a slight distance from the bottom wall 14 of the drainage channel sections. However, the connecting member can engage and even support the bottom wall of the drainage channel sections according to other embodiments of the present invention.

In the preferred embodiment, the pairs of corresponding longitudinally opposed surfaces 34*a*, 34*a* and 34*b*, 34*b* of the jaw members 32 are inwardly converging with respect to a longitudinal axis 44 defined by the aligned drainage channel sections 12. In other words, the corresponding longitudinally opposed surfaces of the first and second jaw members, 34*a* and 34*b* are each diagonally oriented with respect to longitudinal axis 44 and are converging with respect to each other. As seen in FIG. 4, the corresponding longitudinally opposed surfaces of the jaw members are inwardly converging in generally opposing longitudinal directions outwardly from the joint between channel sections, as illustrated by the opposed arrows 45 in FIG. 4.

As best seen in FIGS. 1 and 3, the opposed jaw members 32 also preferably include corresponding vertically extending surfaces positioned to engage predetermined exterior portions of the respective sidewalls 16 of the adjacent drainage channel sections 12 in order to align the sidewalls of the channel sections along substantially the same general vertical axes. In the illustrated embodiment, the longitudinally opposed surfaces 34*a* and 34*b* of the jaw members extend in the vertical direction as well as in the longitudinal direction and thus accomplish this vertical alignment as well as compressing the channel sections longitudinally together. In the preferred embodiment shown in the drawings, the corresponding the vertically extending surfaces of the jaw members are also inwardly converging along a generally vertical direction. However, the vertically extending surfaces can be oriented differently if desirable, for example, due to different sidewall orientation in a particular drainage channel configuration, and/or the opposed jaw members can include a distinct vertically extending surface, separate from the longitudinally opposed surfaces, to accomplish vertical alignment of the sidewalls of the channels.

In addition to longitudinally interlocking the adjacent drainage channel sections 12, the alignment key 30 of the present invention also preferably laterally aligns the adjacent drainage channel sections and vertically position the channels at predetermined heights. In particular, as seen in FIG. 1, each jaw member 32 advantageously includes a lateral surface 46 positioned to engage predetermined exterior portions of the respective sidewalls 16 to laterally align the adjacent drainage sections. As best illustrated in FIG. 5, each tab 33 on the jaws 32 which provide the longitudinally opposed surfaces 34*a* and 34*b* can preferably include a lateral alignment surface 46 which engages each respective sidewall laterally along a portion thereof to laterally align the adjacent drainage channel sections. Thus, upon application of a laterally inwardly directed force, to each jaw member 32 such as by cooperation of the connecting member 40 and the laterally movable member 40, the lateral alignment surfaces 46 of the opposed jaw members exert a lateral alignment force on the opposed sidewalls of the abutting channel sections to laterally align the channel sections.

Each jaw member 32 also preferably includes a surface positioned to engage predetermined exterior portions of the respective sidewalls 16 to align the adjacent drainage channel sections 12 at a predetermined relative vertical height. For example, as best illustrated in FIGS. 3 and 5, each jaw member includes a substantially horizontally extending portion or horizontal tab 48. The horizontal tab 48 is positioned to engage a generally downwardly directed horizontal surface of longitudinally extending outwardly projecting ribs 50 defined along lower portions of the opposed sidewalls of the channel sections. Accordingly, the generally horizontally extending tabs 48 engage and support lower portions of the longitudinally extending ribs to align the adjacent drainage channel sections in a predetermined vertical relationship.

As illustrated in the drawings, the horizontal tabs 48 are constructed and arranged to align the adjacent drainage channel sections 12 such that the trench defined thereby has a generally level or unsloped bottom surface. Alternatively, the bottom walls 14 of the drainage channel sections can be vertically sloped to facilitate run-off or fluid flow through the trench. In such an alternative construction, the surface 48 of each jaw member 32 which aligns the adjacent drainage channel sections in a predetermined vertical relationship is preferably positioned to align the adjacent drainage channel sections in the predetermined vertically sloping relationship.

As illustrated in FIG. 3, each jaw member 32 preferably includes at least one additional horizontal tab 49 positioned in vertically relation to vertically spaced the lower horizontal tab 48. Each horizontally extending tab 48, 49 includes a bore 52 positioned therein such that the two bores 52 are generally aligned in a vertical direction. The alignment of bores 52 can be generally perpendicular to the longitudinal axis of tabs 48 and 49 when the drainage channel sections are configured with level bottom walls. In embodiments of the present invention in which the bottom walls 14 of the drainage channel sections 12 are vertically sloped, the bores defined in the horizontally extending portions of each jaw member are preferably positioned to be in general vertical upright alignment when the jaw member is oriented according to the vertically sloping relationship defined by the bottom walls of the drainage channel sections. For example, a bore can be defined in the upper horizontally extending tab 49 as depicted by reference numeral 54 in FIGS. 3 and 4 so as to be generally vertically aligned when the jaw member is oriented in a vertically sloping direction One or both of the horizontally extending tabs 48 and 49 of each jaw member 32 is adapted for movement relative to the other tab in response to a predetermined force to thereby change the alignment of the bores 52. More specifically, at least one of the horizontally extending tabs is adapted to move in response to the laterally inwardly directed force applied to the jaw members, such as caused by the tightening of wing nut 42 on the connecting rod 40. As discussed below, changing the alignment of the bores 52 effectively locks the jaw member on a support rod 56. The bores in the tabs can be constructed and positioned in various alternative arrangements to change alignment of the bores as a result of movement either in a horizontal direction, a vertical direction or a direction which includes both horizontal and vertical components in response to the predetermined force.

The alignment key 30 also preferably includes a plurality of vertical support members 56. As illustrated in FIG. 5, the vertical support members can be integrally connected legs of a generally U-shaped anchoring member 58. Alternatively, the vertical support member can be a plurality of discrete rods which generally have a foot or other laterally extending portion at a lower end thereof or which are driven into the earth. In either embodiment, the generally vertically aligned bores 52 of the horizontally extending portions 48 of each jaw member 32 are sized and aligned to receive the vertical support member.

When the bores 52 defined in the jaw members 32 are aligned in the same direction as the support rod 56, the jaw member is free to move vertically on the support member. The position of a jaw member 32 with respect to the vertical support member 56 extending through the aligned bores 52 of the horizontally extending portions 48 of the jaw member can also be fixed as a result of application of a predetermined force to the jaw members. For example, once the position of a jaw member relative to a vertical support member, which extends through the vertically aligned bores of the horizontally extending portions of the jaw member, is selected, the laterally inwardly directed force can be applied, such as through tightening of wing nut 40 on the connecting rod 40, to change the alignment of the bores. By changing the alignment of the bores, the jaw member is secured or fixed to the vertical support member. Accordingly, the relative spacing between the bottom wall 14 of the drainage channel sections 12 and the bottom of the ditch, with which lower portions of the vertical support member are engaged, can be controllably selected. As best seen in FIG. 5, each of the jaw tabs 33 is moved in an upward direction as it is forced into contact with the upper beveled surface of the longitudinal lip 50 of the channel section. In turn, this movement causes upper horizontal tab 49 of the jaw to move upwardly to lock the jaw member on the support 56.

In the embodiment of the invention shown in the drawings, each drainage channel section 12 preferably has an outwardly extending vertical lip 60 of a predetermined lateral width proximate the opposed ends of the drainage channel section. Each jaw member 32 includes a recessed central portion 62 defined between the longitudinally opposed surfaces 34. As illustrated in FIG. 4, the recessed central portion has a predetermined longitudinal width adapted to receive the lips of the adjacent drainage channel sections.

Figure 6A:
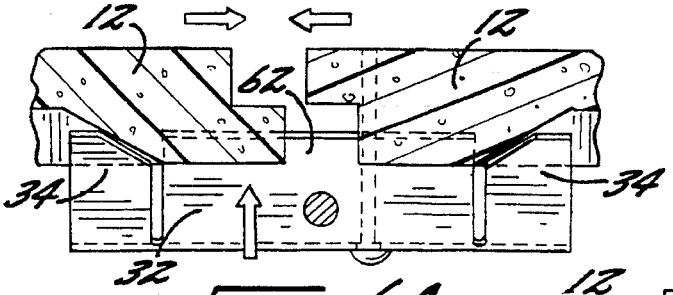
FIGS. 6A–6C are exaggerated fragmentary top cross-sectional views taken along line 6—6 of FIG. 5 and illustrate movement of aligned channel sections in response to application of a longitudinally compressive force by the jaw members one jaw member of an alignment key according to the present invention illustrating the alignment of the adjacent drainage channel sections upon the application of a laterally inwardly directed force thereto.
Figure 6B:
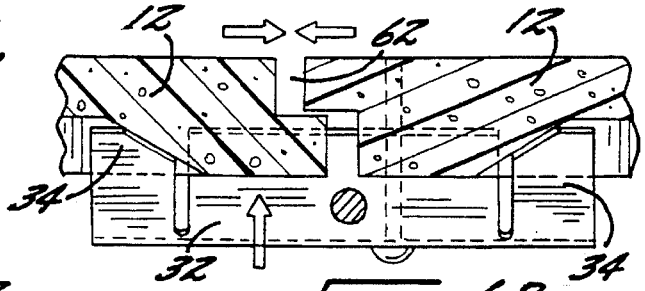
Figure 6C:
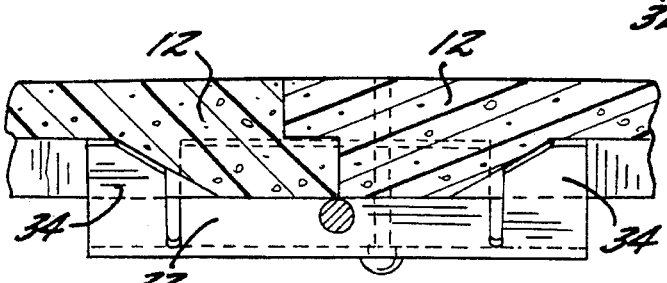

As illustrated in FIGS. 6A–6C, the application of a laterally inwardly directed force to the opposed jaw members 32 urges the adjacent drainage channel sections 12 into a longitudinally interlocked and aligned relationship due to the camming action of the complimentarily shaped longitudinally opposed surfaces **34*a* and 34*b* of the opposed jaw members on the exterior surfaces of predetermined shape of the opposed sidewalls 16 of the adjacent drainage channel sections. In particular, as the opposed jaw members are drawn laterally inward, the adjacent drainage channel sections are forced together as illustrated in FIGS. 6A–6C** which serially depict increasing amounts of laterally inwardly directed force being applied to the opposed jaw members so that the opposed jaw members are drawn laterally together.

The aligned and interlocked drainage channel sections 12 are then anchored within the ditch 64. In particular, vertical support members 56 preferably extend through the aligned bores 52 defined in the horizontally extending portions 48, 49 of each of the jaw members 32 as described hereinabove. The alignment of the bores is then changed such that the position of the jaw members relative to the vertical support members is fixed.

Since the vertical support members 56 engage the bottom of the ditch 64 as shown in FIG. 2, the position of the drainage channel sections 12 relative to the bottom of the trench can be selectably controlled by positioning the jaw members 32 on the respective vertical support members. Once the drainage channel sections are positioned relative to the bottom of the trench, a subslab 66 can then be formed around lower portions of the vertically extending members at a location spaced below the bottom walls 14 of the drainage channel sections to anchor the vertical support members and, in turn, the drainage channel sections in the ditch.

For example, in the illustrated embodiment of the present invention in which the vertical support members 56 are legs of a generally U-shaped member 58, the generally U-shaped member also includes a central portion 68 extending between the vertical support members. As shown, the central portion of the U-shaped member generally rests on the bottom of the ditch 64 such that the generally U-shaped member can be anchored within the ditch by forming a subslab 66 around the central portion of the U-shaped member at a location spaced below the bottom walls 14 of the drainage channel sections 12.

Once the subslab 66 has cured or set, hardenable composition can be poured around the anchored drainage channel sections 12 to form a completed drainage channel as the moldable composition sets. A grate 20 can then be placed across the open top of the trench as shown in FIG. 2. Preferably, the upper surface of the hardenable composition is substantially coplanar with the upper portions of the sidewalls 16 of the drainage channel sections and the grate to form a level surface. Therefore, a drainage trench defined by a plurality of drainage channel sections which are longitudinally interlocked and which are both vertically and laterally aligned can be readily formed according to the method and apparatus of the present invention.

Although an alignment key 30 having a particular shape and configuration is illustrated and described hereinabove, alignment keys having other shapes which align and longitudinally interlock adjacent drainage channel sections 12 can also be employed without departing from the spirit and scope of the present invention. For example, although the horizontal tab 48 and opposed clamping surfaces 34*a* and 34*b* are illustratively depicted as extending substantially equal distances inward, the horizontal tab and opposed clamping surfaces can extend inwardly different distances without departing from the spirit and scope of the present invention.

In addition, although the opposed clamping surfaces 34*a* and 34*b* are illustratively shaped to match the upper beveled surface of the longitudinal lip 50 of a drainage channel section 12, the shape and angle of the opposed clamping surfaces need not match the upper beveled surface of the longitudinal lip, but can, instead, be formed in other shapes while still engaging exterior portions of the sidewalls 16 of the drainage channel sections. Such variations in shape and angle may be particularly desirable in instances in which the increases in the flexibility or modulus of the opposed clamping surfaces are advantageous.

Still further, although the horizontal tab 48 is described and shown as extending horizontally inward, the tab can extend at other angles without departing from the spirit and scope of the present invention. For example, the tab can extend generally vertically upward and horizontally inward to contact the lower surface of the longitudinal lip 50 of a drainage channel section 12. As described above, such variations in shape and angle of the horizontal tab may be particularly desirable in instances in which the increases in the flexibility or modulus of the tab are advantageous.

Figure 7:
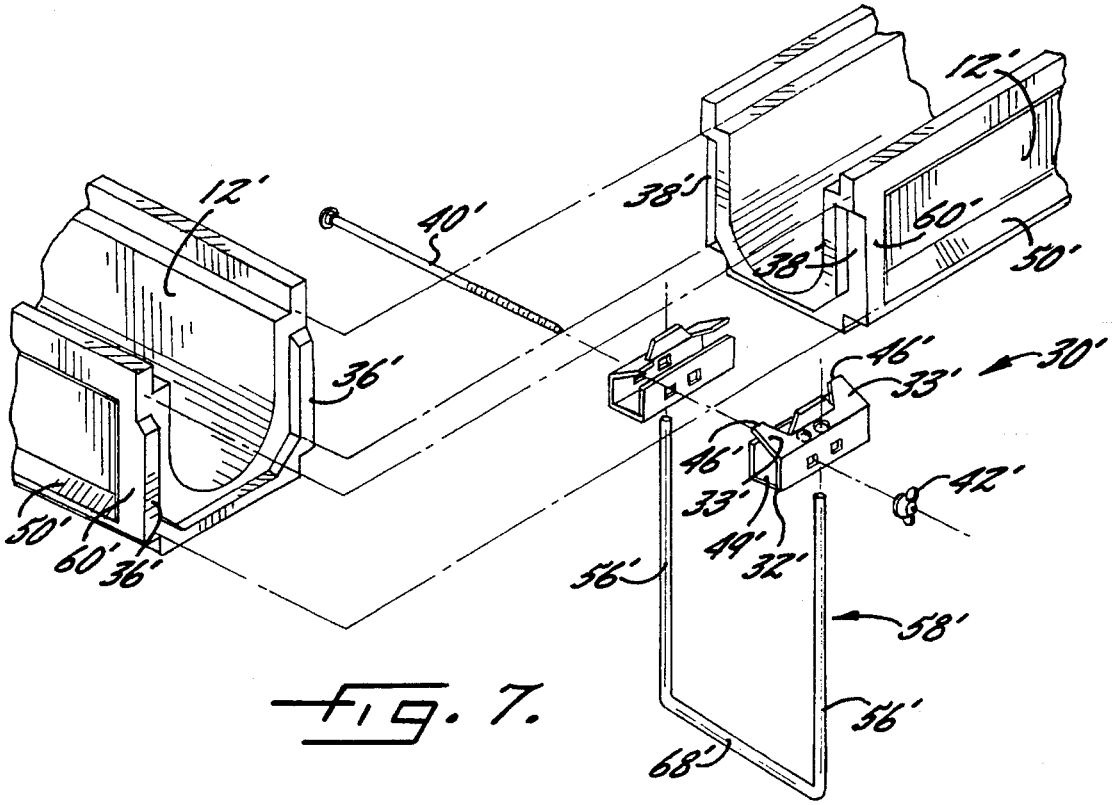
FIG. 7 is a perspective view of another embodiment of an alignment key according to the present invention.

One alternative embodiment of an alignment key 30' is illustrated in FIG. 7. As shown, the alignment key 30' of FIG. 7 has opposed jaw members 32', each of which includes two clamping tabs 33' which, in turn, have longitudinally opposed clamping surfaces 34*a*' and 34*b*' which engage predetermined exterior portions of the respective sidewalls 16' of the adjacent drainage channel sections 12' for aligning and longitudinally interlocking the drainage channel sections as described above. In addition, each jaw member of this embodiment of the alignment key includes a vertical alignment surface 48' and a lateral alignment surface 46' which are separate from the longitudinally opposed surfaces of the jaw members. As illustrated and described above, however, each clamping tab 33' can include a vertical alignment surface. According to this alternative embodiment, each jaw member includes a generally vertically upstanding portion 70' which engages the respective sidewalk of the drainage channel sections to cooperate with the lateral alignment surfaces to laterally align the drainage channel sections. This embodiment of the alignment key also includes vertical support members 56' which can be legs of a generally U-shaped member 58' for anchoring the alignment key and, in turn, the adjacent drainage channel sections in a preformed ditch during the pouring of a hardenable composition thereabout, as also in detail previously.

Figure 8:
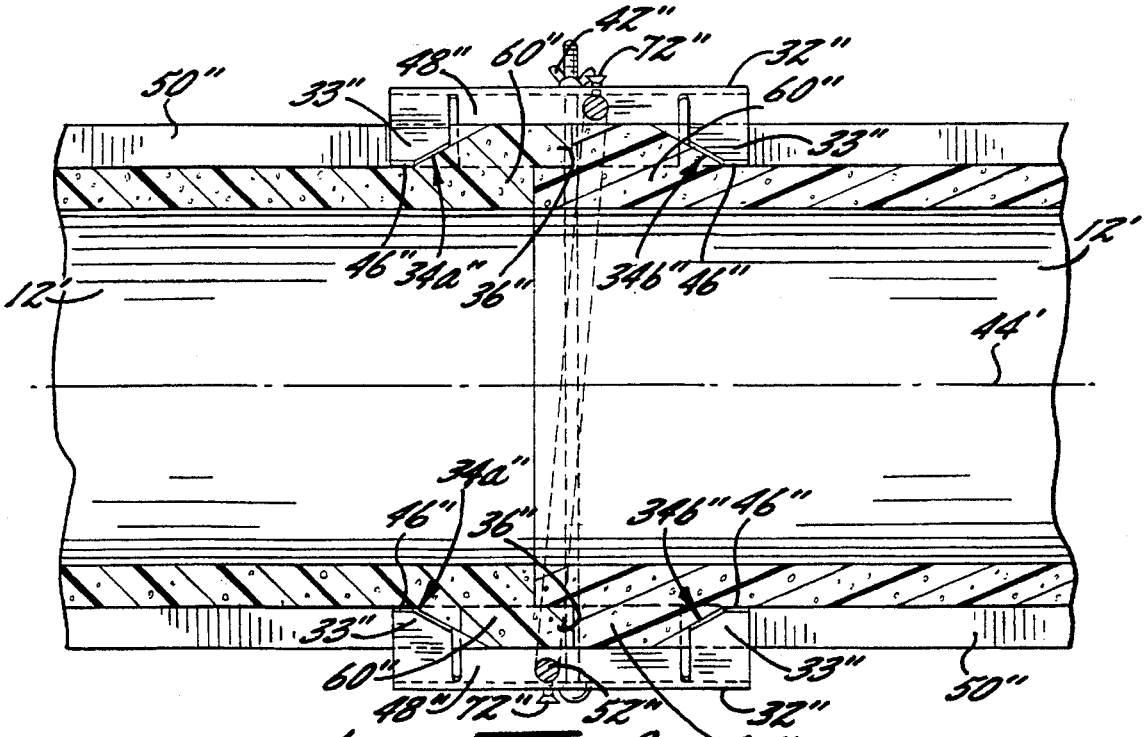
FIG. 8 is a top plan view of a drainage channel system according to the present invention illustrating another embodiment of an alignment key.

Another alternative embodiment of an alignment key 30" according to the present invention is illustrated in FIG. 8. As shown, the alignment key of FIG. 8 has opposed jaw members 32", each of which includes two clamping tabs 33" which, in turn, have longitudinally opposed clamping surfaces 34*a*" and 34*b*" which engage predetermined exterior portions of the respective sidewalls 16" of the adjacent drainage channel sections 12" for aligning and longitudinally interlocking the drainage channel sections as described above. In addition, each jaw member of this embodiment of the alignment key includes a connecting member 40" which extends through apertures defined in centrally located portions of side portions of each jaw member 32".

As illustrated, the horizontally aligned bores 52" defined in the horizontal tabs 48" and 49" of this embodiment of the alignment key 30" are preferably on opposed sides of the connecting member 40". Accordingly, the laterally inwardly directed force exerted by the combination of the jaw members 32" and the vertical support members 56" on adjacent drainage channel sections 12" is spread substantially evenly between each of the opposed clamping tabs as the laterally moveable member 42" is tightened upon the connecting member. For example, each opposed pair of clamping surfaces 34*a*" and 34*b*" exert substantially equal amounts of laterally inwardly directed force as the laterally moveable member 42" is tightened upon the connecting member.

Although the laterally inwardly directed force applied by the connecting member 40" and the laterally moveable member 42" secures each jaw member 32" to the corresponding vertical support member 56", it is desirable in some instances, such as instances in which a relatively large force will be applied to upper portions of the drainage channel sections 12" prior to pouring hardenable composition about the drainage channel sections, in order to provide additional, reinforcement for securing each jaw member to the corresponding vertical support member. Accordingly, in the embodiment of the alignment key 30" illustrated in FIG. 8, the alignment key includes a pair of set screws 72". As shown, at least one set screw is inserted through a bore defined in the side portion of each jaw member to engage a vertical support member. Thus, the position of each jaw member relative to the vertical support member and, in turn, relative to the earth is further fixed. Although not illustrated, the other embodiments of the alignment key, such as those illustrated in FIGS. 1–7, could also include one or more set screws for fixing the position of each jaw member relative to a vertical support member.

According to the present invention, a plurality of drainage channel sections 12 are aligned and longitudinally interlocked within a preformed ditch 64. The plurality of drainage channel sections are aligned, according to the invention, with an alignment key 30 longitudinally bridging between each adjacent pair of drainage channel sections. As described above, the alignment key longitudinally interlocks the adjacent drainage channel sections by applying a longitudinally compressive force. The adjacent drainage channel sections are also preferably aligned by the alignment key and, more preferably, are both laterally and vertically aligned by engagement of predetermined exterior portions of the respective sidewalls 16 of the adjacent drainage channel sections with the lateral alignment surface 46 and the vertical alignment surface 48, respectively, of the jaw member 32.

The opposed jaw members 32 are urged into engagement with the respective sidewalls 16 of the adjacent drainage channel sections 12 by laterally inwardly directed force. This laterally inwardly directed force can be applied, for example, by the cooperation of the connecting member 40 and the laterally movable member 40. By urging the opposed jaw members into engagement with the respective sidewalls of the adjacent drainage channel sections, the adjacent drainage channel sections are aligned and longitudinally interlocked.

The invention has been described in considerable detail with reference to preferred embodiments. However, many changes, variations, and modifications can be made without departing from the spirit and scope of the invention as described in the foregoing specification and defined in the appended claims.

That which is claimed is:

1. An alignment key for aligning and interlocking adjacent drainage channel sections, each longitudinally extending drainage channel section having a predetermined exterior shape defined by a bottom wall and first and second sidewalls extending upwardly from opposite sides of the bottom wall, the alignment key comprising:

first and second opposed, inwardly facing jaw members shaped for longitudinally bridging across a predetermined exterior portion of adjacent first, and adjacent second sidewalls, respectively, of the adjacent drainage channel sections;

each of said jaw members including longitudinally opposed surfaces positioned to engage the predetermined exterior portions of the respective sidewalls and to apply a longitudinally compressive force to the adjacent drainage channel sections to thereby substantially align and interlock the drainage channel sections.

2. An alignment key according to claim 1 wherein each jaw member also includes a surface positioned to engage the predetermined exterior portions of the respective sidewalls to laterally align the adjacent drainage channel sections.

3. An alignment key according to claim 1 wherein each jaw member also includes a surface positioned to engage the predetermined exterior portions of the respective sidewalls to align the adjacent drainage channel sections in a predetermined vertical relationship.

4. An alignment key according to claim 3 wherein each drainage channel section extends between opposite ends, wherein the first and second sidewalls of each drainage channel section extend upwardly from opposite sides of the bottom wall to respective upper surfaces, wherein each drainage channel section has a height as measured between the bottom wall and the upper surface thereof, wherein the bottom walls of the drainage channel sections are sloping with respect to a horizontal plane such that each drainage channel section has a different height at each of the opposite ends thereof, and wherein the surface of each jaw member which aligns the adjacent drainage channel sections in a predetermined vertical relationship is positioned to align the adjacent drainage channel sections in a determined sloping relationship.

5. An alignment key according to claim 1 further comprising at least one connecting member connecting bottom portions of each of said jaw members in a laterally spaced relationship.

6. An alignment key according to claim 5 wherein each jaw member further comprises at least one horizontally extending portion, each horizontally extending portion comprising a bore, said bore of each jaw member being positioned on longitudinally opposed sides of said connecting member.

7. An alignment key according to claim 5 further comprising a laterally moveable member cooperating with said connecting member to adjust the lateral spacing between said opposed jaw members.

8. An alignment key according to claim 7 wherein said laterally moveable member and said connecting member cooperate to apply a laterally inwardly directed force to said opposed jaw members.

9. An alignment key according to claim 8 wherein each jaw member further comprises at least two horizontally extending, vertically spaced portions, each horizontally extending portion comprising a bore, said bores being generally aligned in a vertical direction and wherein at least one of said horizontally extending portions is adapted for movement relative to another of the horizontally extending portions in response to a predetermined force to thereby change the alignment of said bores.

10. An alignment key according to claim 9 wherein at least one of said horizontally extending portions is adapted to move in response to the laterally inwardly directed force applied to said jaw members by said laterally moveable member and said connecting member.

11. An alignment, key according to claim 10 wherein at least one of said horizontally extending portions is adapted to move in a vertical direction.

12. An alignment key according to claim 10 wherein at least one of said horizontally extending portions is adapted to move in a horizontal direction.

13. An alignment key according to claim 9 further comprising a plurality of vertical support members, wherein said generally vertically aligned bores are adapted for receiving said vertical support members.

14. An alignment key according to claim 13 wherein said vertical support members are legs of a generally U-shaped member.

15. An alignment key according to claim 9 wherein each of said drainage channel sections extends between opposite ends and has an outwardly extending lip of a predetermined width proximate the opposed ends thereof, and wherein each jaw member includes a recessed central portion defined between said opposed longitudinal surfaces, said recessed central portion having a predetermined longitudinal width adapted to receive the said lips of said adjacent drainage channel sections.

16. An alignment key according to claim 1 wherein the corresponding longitudinally opposed surfaces of said jaw members are inwardly converging with respect to a longitudinal axis of each drainage channel.

17. An alignment key according to claim 16 wherein the corresponding longitudinally opposed surfaces of the jaw members are inwardly converging in generally opposed longitudinal directions.

18. An alignment key according to claim 1 wherein said jaw members comprise corresponding vertically extending surfaces positioned to engage predetermined exterior portions of the respective sidewalls, and wherein said vertically extending surfaces are inwardly converging along a generally vertical direction.

19. An alignment key for aligning and interlocking adjacent drainage channel sections, each longitudinally extending drainage channel section having a predetermined exterior shape defined by a bottom wall and first and second sidewalls extending upwardly from opposite sides of the bottom wall, the alignment key comprising:

first and second opposed, inwardly facing jaw members shaped for longitudinally bridging between adjacent drainage channel sections and for mating With an exterior portion of predetermined shape of the first and second sidewalls, respectively, of the adjacent drainage channel sections;

each of said jaw members including a pair of longitudinally opposed clamping members shaped to engage the exterior portion of the respective sidewalls and to urge the adjacent drainage channel sections into an aligned, longitudinally engaged relationship.

20. An alignment key according to claim 19 wherein the exterior portion of predetermined shape of the first and second sidewalls includes an exterior angled surface oriented in both a longitudinal and an outward direction, and wherein the corresponding longitudinally opposed clamping members of said jaw members are inwardly converging with respect to a longitudinal axis of each drainage channel to engage the exterior angled surface.

21. An alignment key according to claim 20 wherein the corresponding longitudinally opposed clamping members of said jaw members are inwardly converging in generally opposed longitudinal directions.

22. An alignment key according to claim 20 wherein said jaw members comprise corresponding vertically extending surfaces positioned to engage the exterior angled surface of the respective sidewalls, and wherein the vertically extending surfaces are inwardly converging along a generally vertical direction.

23. An alignment key according to claim 19 wherein said alignment key further comprises a vertical alignment surface shaped to engage and vertically align the bottom walls of each of the adjacent drainage channel sections.

24. An alignment key according to claim 23 wherein each drainage channel section extends between opposite ends, wherein the first and second sidewall of each drainage channel section extend upwardly from opposite sides of the bottom wall to respective upper surfaces, wherein each drainage channel section has a height as measured between the bottom wall and the upper surface thereof, wherein the bottom walls of the drainage channel sections are sloping with respect to a horizontal plane such that each drainage channel section has a different height at each of the opposite ends thereof, and wherein said vertical alignment surface is shaped to align the adjacent drainage channel sections in a predetermined sloping relationship.

25. An alignment key according to claim 19 wherein each jaw member also includes a surface to laterally align the adjacent drainage channel sections.

26. An alignment key according to claim 19 further comprising at least one connecting member connecting said opposed jaw members in a laterally spaced relationship.

27. An alignment key according to claim 26 wherein each jaw member further comprises at least one horizontally extending portion, each horizontally extending portion comprising a bore, said bore of each jaw member being positioned on longitudinally opposed sides of said connecting member.

28. An alignment key according to claim 26 further comprising a laterally moveable member cooperating with said connecting member to adjust the lateral spacing between said opposed jaw members.

29. An alignment key according to claim 28 wherein said laterally moveable member and said connecting member cooperate to apply a laterally inwardly directed force to said opposed jaw members.

30. An alignment key according to claim 29 wherein each jaw member further comprises at least two horizontally extending, vertically spaced portions, each horizontally extending portion comprising a bore, said bores being generally aligned in a vertical direction and wherein at least one of said horizontally extending portions is adapted for movement relative to another of the horizontally extending portions in response to a predetermined force to thereby change the alignment of said bores.

31. An alignment key according to claim 30 wherein at least one of said horizontally extending portions is adapted to move in response to the laterally inwardly directed force applied to said jaw members by said laterally moveable member and said connecting member.

32. An alignment key according to claim 30 further comprising a plurality of vertical support members, wherein said vertically generally aligned bores are adapted for receiving said vertical support members.

33. An alignment key according to claim 32 wherein said vertical support members are legs of a generally U-shaped member.

34. An alignment key according to claim 30 wherein each of said drainage channel sections extends between opposite ends and has an outwardly extending lip of a predetermined width proximate the opposed ends thereof, and wherein each jaw member includes a recessed central portion defined between said opposed longitudinal surfaces, said recessed central portion having a predetermined longitudinal width adapted to receive the said lips of said adjacent drainage channel sections.

35. A drainage channel system comprising:

a plurality of longitudinally extending drainage channel sections, each drainage channel section having a predetermined exterior shape defined by a bottom wall and first and second sidewalls extending upwardly from opposite sides of the bottom wall; and an alignment key for aligning and interlocking adjacent drainage channel sections, said alignment key comprising first and second opposed, inwardly facing jaw members shaped for longitudinally bridging across a predetermined exterior portion of the adjacent first, and adjacent second sidewalls, respectively, of said adjacent drainage channel sections, each of said jaw members including longitudinally opposed surfaces shaped to engage the exterior portion of said sidewall and to urge said adjacent drainage channel sections into an aligned, longitudinally engaged relationship.

36. A drainage channel system according to claim 35 wherein the exterior portion of predetermined shape of the first and second sidewalls includes an exterior angled surface oriented in both a longitudinal and an outward direction, and wherein the corresponding longitudinally opposed surfaces of said jaw members are inwardly converging with respect to a longitudinal axis of each drainage channel to engage the exterior angled surface.

37. A drainage channel system according to claim 36 wherein the corresponding longitudinally opposed surfaces of said jaw members are inwardly converging in generally opposed longitudinal directions.

38. A drainage channel system according to claim 36 wherein said jaw members comprise corresponding vertically extending surfaces positioned to engage the exterior angled surface of the respective sidewalls, and wherein the vertically extending surfaces are inwardly converging along a generally vertical direction.

39. A drainage channel system according to claim 35 wherein said alignment key further comprises a vertical alignment surface shaped to engage and vertically align the bottom walls of each of the adjacent drainage channel sections.

40. A drainage channel system according to claim 39 wherein each drainage channel section extends between opposite ends, wherein the first and second sidewalls of each drainage channel section extend upwardly from opposite sides of the bottom wall to respective upper surfaces, wherein each drainage channel section has a height as measured between the bottom wall and the upper surface thereof, wherein the bottom walls of the drainage channel sections are sloping with respect to a horizontal plane such that each drainage channel section has a different height at each of the opposite ends thereof, and wherein said vertical alignment surface is shaped to align the adjacent drainage channel sections in a predetermined sloping relationship.

41. A drainage channel system according to claim 35 wherein each jaw member also includes a surface to laterally align the adjacent drainage channel sections.

42. A drainage channel system according to claim 35 wherein said alignment key further comprises at least one connecting member connecting said opposed jaw members in a laterally spaced relationship.

43. A drainage channel system according to claim 42 wherein each jaw member further comprises at least one horizontally extending portion, each horizontally extending portion comprising a bore, said bore of each jaw member being positioned on longitudinally opposed sides of said connecting member.

44. A drainage channel system according to claim 42 wherein said alignment key further comprises a laterally moveable member cooperating with said connecting member to adjust the lateral spacing between said opposed jaw members.

45. A drainage channel system according to claim 44 wherein said laterally moveable member and said connecting member cooperate to apply a laterally inwardly directed force to said opposed jaw members.

46. A drainage channel system according to claim 45 wherein each jaw member further comprises at least two horizontally extending, vertically spaced portions, each horizontally extending portion comprising a bore, said bores being generally aligned in a vertical direction and wherein at least one of said horizontally extending portions is adapted for movement relative to another of the horizontally extending portions in response to a predetermined force to thereby change the alignment of said bores.

47. A drainage channel system according to claim 46 wherein at least one of said horizontally extending portions is adapted to move in response to the laterally inwardly directed force applied to said jaw members by said laterally moveable member and said connecting member.

48. A drainage channel system according to claim 46 wherein said alignment key further comprises a plurality of vertical support members, wherein said generally vertically aligned bores are adapted for receiving said vertical support members.

49. A drainage channel system according to claim 48 wherein said vertical support members are legs of a generally U-shaped member.

50. A drainage channel system according to claim 46 wherein each of said drainage channel sections extend between opposite ends and has an outwardly extending lip of a predetermined width proximate the opposed ends thereof, and wherein each jaw member includes a recessed central portion defined between said opposed longitudinal surfaces, said recessed central portion having a predetermined longitudinal width adapted to receive the said lips of said adjacent drainage channel sections.

51. A method of forming a drainage channel comprised of a plurality off longitudinally extending drainage channel sections, each drainage channel section having a predetermined exterior shape defined by a bottom wall and first and second sidewalls extending upwardly from opposite sides of the bottom wall, the method comprising the steps of:

providing a ditch for the drainage channel;

aligning the plurality of drainage channel sections with at least one alignment key wherein each alignment key includes first and second opposed, inwardly facing jaw members for longitudinally bridging across a predetermined exterior portion of adjacent first, and adjacent second sidewalls, respectively, of the adjacent drainage channel sections, each jaw member including longitudinally opposed surfaces positioned to engage the predetermined exterior portions of the respective sidewalls and to apply a longitudinally compressive force to the adjacent drainage channel sections to thereby substantially align the drainage channel sections;

anchoring the aligned drainage channel sections within the ditch; and pouring a moldable composition around the anchored drainage channel sections to form a completed drainage channel as the moldable composition sets.

52. A method according to claim 51 wherein each jaw member also includes a lateral alignment surface, and wherein said aligning step comprises a step of laterally aligning the adjacent drainage channel sections by engaging predetermined exterior portions of the respective sidewalls with the lateral alignment surface of each jaw member.

53. A method according to claim 51 wherein each jaw member also includes a vertical alignment surface, and wherein said aligning step comprises a step of vertically aligning the adjacent drainage channel sections by engaging predetermined exterior portions of the respective sidewalls with the vertical alignment surface of each jaw member.

54. A method according to claim 51 wherein said aligning step further comprises a step of applying a laterally inwardly directed force to the opposed jaw members such that the jaw members are urged against and engage the first and second sidewalls, respectively.

55. A method according to claim 54 wherein the alignment key includes at least one connecting member connecting bottom portions of each of the opposed jaw members in a laterally spaced relationship, the alignment key also including a laterally moveable member cooperatively connected to the connecting member, and wherein said step of applying a laterally inwardly directed force to the jaw members comprises a step of laterally moving the laterally moveable member relative to the connecting member to apply a laterally inwardly directed force to said jaw members and to thereby adjust the lateral spacing between the jaw members.

56. A method according to claim 54 wherein the alignment key further includes at least two horizontally extending vertically spaced portions, each horizontally extending portion comprising a bore, the bores being generally aligned in a vertical direction, and wherein said step of applying a laterally inward, directed force to the opposed jaw members comprises a step of changing the alignment of the bores by moving at least one of the horizontally extending portions relative to another of the horizontally extending portions.

57. A method according to claim 56 wherein the alignment key further comprises a plurality of vertical support members having a first end adapted to be received by the bores defined by the horizontally extending portions, and wherein said step of changing the alignment of the bores includes a step of securing the first end of the vertical support members within the bores defined in the horizontally extending portion such that the position of the jaw member relative to the respective vertical support members is fixed.

58. A method according to claim 57 further comprising the steps of positioning a second end of the vertical support members, opposite the first end, in a lower portion of the ditch and forming a subslab around the second ends of the vertical support members at a location spaced below the bottom surface of the drainage channel sections.

59. A method according to claim 51 wherein each of the drainage channel sections have an outwardly extending lip of a predetermined width proximate the opposed ends thereof, and wherein each jaw member includes a recessed central portion defined between the longitudinally opposed surfaces, the recessed central portion having a predetermined longitudinal width adapted to receive the lips of the adjacent drainage channel sections, and wherein said aligning step further comprises a step of positioning the outwardly extending lips of adjacent drainage channel sections in the recessed central portion.

* * * * *